US011154769B2

(12) United States Patent
Schultheis et al.

(10) Patent No.: US 11,154,769 B2
(45) Date of Patent: Oct. 26, 2021

(54) INTERACTIVE TOPS COLLISION ENHANCING BATTLING ENVIRONMENT

(71) Applicant: Hasbro, Inc., Pawtucket, RI (US)

(72) Inventors: Douglas Arthur Schultheis, Cumberland, RI (US); Hama Hiroyuki, Tokyo (JP); Saito Shina, Tokyo (JP); Charles Latham Gaines, Nashville, TN (US); Luke Lohan, Abington, MA (US)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 16/669,690

(22) Filed: Oct. 31, 2019

(65) Prior Publication Data

US 2020/0139224 A1 May 7, 2020

Related U.S. Application Data

(60) Provisional application No. 62/754,363, filed on Nov. 1, 2018.

(51) Int. Cl.
*A63H 1/00* (2019.01)
*A63F 9/16* (2006.01)

(52) U.S. Cl.
CPC ..... *A63F 9/16* (2013.01)

(58) Field of Classification Search
CPC ..... A63H 1/00–04; A63F 9/16
USPC ..... 446/256–264; D21/338
See application file for complete search history.

(56) References Cited

U.S. PATENT DOCUMENTS

| | | | | |
|---|---|---|---|---|
| 755,446 A | | 3/1904 | Butcher | |
| 1,552,530 A | * | 9/1925 | Woods | A63F 9/16 273/108.1 |
| 1,594,649 A | | 8/1926 | Trautmann | |
| 1,889,680 A | * | 11/1932 | Marmito | A63H 1/00 446/261 |
| 2,148,374 A | | 2/1939 | Hogan | |
| 2,195,083 A | | 3/1940 | Einfalt | |
| 2,364,117 A | | 12/1944 | Wigal | |
| 2,611,995 A | | 9/1952 | Krapp | |

(Continued)

FOREIGN PATENT DOCUMENTS

| | | |
|---|---|---|
| JP | 4659153 B2 | 3/2008 |
| WO | 2013016317 A2 | 1/2013 |

OTHER PUBLICATIONS

Kimimasa et al., Machine Translation of JP Pub. No. 2008-067919(A) (aka JP Pat. No. 4659153(B2)), uploaded Jun. 11, 2020, J-PlatPat, 6 pages.*

*Primary Examiner* — Eugene L Kim
*Assistant Examiner* — Matthew B Stanczak
(74) *Attorney, Agent, or Firm* — Perry Hoffman

(57) ABSTRACT

A battle arena game apparatus with one or more symmetrical side tracks creating a one-way flow pattern that repeatedly exits spinning tops into a middle area of a battling surface to maximize the frequency of collisions between actively spinning tops for enhanced game play and fun for a user. A barrier at an exit of the one or more side tracks prevents the one or more spinning tops from entering the exit of the side tracks creating a one-way flow pattern of the one or more spinning tops from a periphery area of the battling surface to launch into the middle area of the battling surface to continuously engage spinning toy tops in combat.

20 Claims, 6 Drawing Sheets

(56) References Cited

U.S. PATENT DOCUMENTS 2,736,132 A 2/1956 Murray
3,100,643 A * 8/1963 Almashy ..... A63F 9/16 273/119 R
3,229,416 A 1/1966 Bross
3,235,259 A 2/1966 Glass et al.
3,318,600 A * 5/1967 Glass ..... A63F 9/16 273/115
3,531,892 A 10/1970 Pearce
3,712,619 A * 1/1973 Goldfarb ..... A63F 9/16 273/108
3,864,870 A 2/1975 Breslow et al.
3,945,146 A 3/1976 Brown
4,185,739 A 1/1980 Wilford
4,200,283 A * 4/1980 Andrews ..... A63F 9/16 273/108
4,261,466 A 4/1981 Wilford
4,476,650 A 10/1984 Lokvig
4,695,262 A 9/1987 Crosby et al.
4,713,039 A 12/1987 Wong
4,856,790 A * 8/1989 Camillo ..... A63F 9/16 273/317
4,867,727 A 9/1989 Lanius
4,959,035 A 9/1990 Murasaki
4,961,577 A * 10/1990 Gebert ..... A63F 9/16 273/109
4,982,961 A 1/1991 Ichimura
5,110,128 A 5/1992 Robbins
5,411,138 A 5/1995 Klawiter
5,458,523 A 10/1995 Aoki et al.
5,823,845 A 10/1998 O'Berrigan
5,896,991 A 4/1999 Hippely et al.
5,957,745 A 9/1999 Johnson et al.
6,099,380 A 8/2000 Rasmussen
6,270,391 B1 8/2001 Emilsson
6,280,286 B1 8/2001 Andrews
6,406,349 B1 6/2002 Chung
6,604,978 B1 * 8/2003 Abel ..... A63H 1/00 273/109
6,676,476 B1 1/2004 Lund et al.
6,743,070 B1 * 6/2004 Lin ..... A63H 1/02 446/15
7,037,169 B2 5/2006 Benedek et al.
7,296,679 B2 11/2007 Lam
7,389,987 B1 6/2008 Paukert
7,475,881 B2 1/2009 Blagg et al.
D606,125 S * 12/2009 Ujita ..... D21/397
D606,126 S * 12/2009 Ujita ..... D21/397
7,740,518 B2 6/2010 Elliott
8,066,543 B2 * 11/2011 Kitamura ..... A63F 9/16 273/110
8,137,151 B2 3/2012 Kenney
8,568,191 B2 * 10/2013 Rehkemper ..... A63F 9/16 446/259
8,757,628 B1 6/2014 Baker
D806,801 S * 1/2018 Shindo ..... D21/338
D811,487 S * 2/2018 Shindo ..... D21/338
D869,560 S * 12/2019 Schultheis ..... D21/338
D883,389 S * 5/2020 Schultheis ..... D21/338
D884,078 S * 5/2020 Hama ..... D21/338
D884,797 S * 5/2020 Schultheis ..... D21/338
D886,903 S * 6/2020 Ishii ..... D21/338
2003/0168801 A1 9/2003 Zucchi et al.
2003/0199222 A1 * 10/2003 Matsukawa ..... A63H 30/04 446/256
2004/0040349 A1 3/2004 Guttadauro et al.
2005/0104294 A1 5/2005 Chen
2005/0142983 A1 * 6/2005 Matsukawa ..... A63H 1/06 446/246
2006/0255149 A1 11/2006 Retter et al.
2007/0021029 A1 * 1/2007 Weidetz ..... A63H 1/04 446/256
2007/0205554 A1 * 9/2007 Elliott ..... A63H 1/00 273/126 R
2008/0194173 A1 * 8/2008 Tiefel ..... A63H 1/20 446/236
2010/0159798 A1 * 6/2010 Bertrand ..... A63H 1/02 446/259
2011/0171876 A1 * 7/2011 Ujita ..... A63H 1/00 446/264
2011/0256795 A1 * 10/2011 Ujita ..... A63H 1/00 446/264
2011/0256796 A1 * 10/2011 Ujita ..... A63H 1/00 446/264
2013/0324004 A1 12/2013 Schwartz
2013/0324005 A1 * 12/2013 Ferreyra ..... A63H 18/026 446/259
2016/0030848 A1 2/2016 Lema et al.
2016/0035178 A1 2/2016 Judkins et al.
2016/0129354 A1 * 5/2016 Choi ..... A63H 1/00 446/233
2016/0151716 A1 * 6/2016 Nagai ..... A63H 17/004 446/237
2017/0239558 A1 * 8/2017 Shindo ..... A63F 9/16
2017/0333783 A1 * 11/2017 Shindo ..... A63H 1/02
2019/0184278 A1 * 6/2019 Campos ..... A63F 9/16
2020/0129873 A1 * 4/2020 Hama ..... A63H 1/04
2020/0139224 A1 * 5/2020 Schultheis ..... A63F 9/16

* cited by examiner

INTERACTIVE TOPS COLLISION ENHANCING BATTLING ENVIRONMENT

PRIORITY CROSS-REFERENCE TO RELATED APPLICATION

This application claims priority pursuant to 35 U.S.C. 119(e) or 120 from U.S. Provisional Application No. 62/754,363 filed Nov. 1, 2018 for inventions disclosed therein.

FIELD OF THE INVENTION

The present invention relates to a battle arena game apparatus, and more particularly, to a battle arena apparatus with one or more symmetrical side tracks creating a one-way flow pattern that repeatedly exits spinning tops into a middle of a battling surface to maximize the frequency of collisions between actively spinning tops for enhanced game play and fun for a user.

BACKGROUND OF THE INVENTION

The inventions discussed in connection with the present described embodiments address various deficiencies of the prior art. The present inventions address a gaming system designed to enhance play by maximizing the frequency of collisions and interactions between actively spinning tops by continually exiting the tops from one or more symmetrical side tracks to the middle of the battling surface where collisions are most likely to occur. A barrier/step at the exit of each side track prevents tops on the battling surface from entering side tracks through their exit and instead directs the spinning tops into an entrance at each side track to facilitate the depositing of spinning tops into the middle of the battling surface.

There are known toy top play pads, toy top entertainment systems, and battle arenas which provide a surface along which toy tops are spun, travel in a specified direction along a rail element, or travel around on a circular platform. It is known to employ a circular arena for providing a surface on which toy tops can spin and possibly interact with one another, or to provide a rail element to guide a toy top along the direction of the rail.

There is a known toy top play pad which employs a circular launch pad and runway pad in juxtaposition with the launch pad as exemplified and disclosed in JP4659153 titled Game Table for a toy top, issued Mar. 27, 2008 to Jenoido Proto Design KK. Toy tops are spun into the circular launch pad where they revolve around the perimeter of the concave launch pad and discharge onto a runway pad in a racing fashion. A guide plate directs the tops only from the launch pad to the running pad where a user can race tops through running grooves and compete for running speeds. The running grooves are carved into the runway pad and are designed to capture a tip of the toy tops as they enter the runway pad. The running grooves cut into the surface of the runway pad and direct the tops to circle around the perimeter of the play pad. The tip of each toy top is circular in shape and comes into point contact with the bottom surface of the running groove to allow the tip of the top to rotate and spin as it travels within the running groove, as shown as prior art in FIG. 3 of the present application. The circular tips of the spinning tops rolls along the running groove and circles the perimeter of the play pad in a racing fashion.

The circular launch pad is only a landing pad for toy tops to be introduced to the play pad before they are captured by the running grooves as the toy tops circle the outer perimeter of the circular launching pad. The toy tops enter the running grooves and are then directed around the runway pad circuit in a racing fashion and never collide in the circular launch pad nor are the runway pads guiding the tops into the middle of the circular launch pad to encourage collisions between the spinning toy tops. There is only an entrance into the runway pad from the circular launching pad without any disclosure for an exit from the runway pad to the circular launching pad for directing tops back to the circular launch pad, from the running pad, to collide with other spinning tops. The running pad has only an entrance from the circular launching pad, without any exits back to the circular launching pad preventing spinning tops from redirection into the middle of the circular launch pad.

There is also a known toy top entertainment system with interchangeable top components and interchangeable rail arrangements as exemplified and disclosed in WO 2013/016317 A2 Dynamic Entertainment System, published Jan. 31, 2013 to Gaines. The top entertainment system discloses interchangeable tops engaging and riding along interchangeable rail elements to maximize vector velocity in transit along the rail elements. The toy tops are launched onto a flat launch support adjacent a rail element. The tops have a ring with a ring side wall perpendicular with a pivoting axis and capable of engaging a rail side wall of the rail elements of the rail path in rolling line contact to travel along the line of the rail path.

Additionally, there are known battle arena game apparatuses including an arena or stadium for a game of spinning battle tops. The arena can accommodate two players when placed in one orientation and four players after being flipped to another configuration. Also, the circular stadium-shaped game board that may be integrated with a computer.

Beyblade™ spinning tops are known as physical game pieces. The described Beyblade™ spinning top usually includes a device, such as a ripcord, to help a player make the top spin. One or more players may engage in games where one or more players spin two or more tops so that the tops may "battle", where the player whose top is the last top spinning wins. The "battle" may include the tops colliding one or more times. The tops may have different designs where each design causes a top to respond to collisions in a unique way, thus adding a skill element to choosing opposing tops. In some embodiments, the game may further use physical game battle arena game apparatus in an integrated multi-environment interactive battle game physical game board, convertible or converting arena, e.g., being turned upside down and used as a stadium for plural or multiple players to spin two or more Beyblade™ tops so that the tops battle within the stadium confines by spinning and knocking into each other until only one top remains spinning.

Significantly, known toy top play pads and arenas do not combine a battle arena apparatus with one or more symmetrical side tracks creating a one way flow pattern that repeatedly exits spinning tops into a middle of a battling surface to maximize the frequency of collisions between actively spinning tops for enhanced game play and fun for a user. It would be desirable to provide a side track extending from a battling surface including an exit for repeatedly launching spinning tops on the side track back into the middle of the battling surface for combat. A barrier/step at the exit of each side track prevents spinning tops at the battling surface from entering the exit of each side track establishing a one-way flow of tops continuously directed to the middle of the battling surface for combat. One or more spinning toy tops, each having an elongated tip with an outer tip surface for engaging a side rail and gliding along the side track combine to create a one way flow of the one or more spinning tops from a perimeter of the battling surface, through the side track, and launching back into the middle of the battling surface to continuously engage each other in combat.

SUMMARY OF THE INVENTION

The present invention addresses shortcomings of the prior are to provide a battle arena and toy top in combination, which simply yet uniquely maximizes the frequency of collisions between actively spinning tops for enhanced game play and fun for a user. Side tracks in mechanical engagement with a battling surface redirect unengaged spinning tops from the outer periphery of the battling surface back into the middle of the battling surface for reengagement with other spinning tops to maximize collisions between the spinning tops at the battling surface.

In one embodiment of the invention, a battle arena game apparatus in combination with a toy top includes a concave arena having a battling surface for one or more spinning tops to engage each other in combat, the battling surface having a middle area surrounded by a periphery area. A side track is extending from the periphery area of the battling surface, with the side track having an entrance and an exit, and a side rail is partially extending the length of the side track and defining a side path along the side track, with a banked or inclined surface along the path, the banked surface inclining toward the side rail. A barrier is provided at the exit of the side track for preventing the one or more spinning tops from entering the exit of the side track, and one or more spinning toy tops having an elongated tip with a partially flat riding tip surface is provided for gliding along the banked side path and having an outer tip surface for engaging the side rail to direct a one way flow of the one or more spinning tops from the periphery area of the battling surface, through the side track, and launching to the middle area of the battling surface to continuously engage spinning toy tops in combat.

In another embodiment of the invention, the barrier at the exit of the side track further includes a step elevated from the surface of the periphery of the battling surface for preventing spinning tops at the battling surface from entering the exit of the side track. In another embodiment, a second side rail is further included and partially extending along the length of the side track is provided and coordinating with the first side rail defining the side path therebetween first and second side rails, and in another embodiment, a second side track symmetrical with the first side track is further provided and includes first and second side rails and a banked surface inclining toward the first side rail defining a second banked side path therebetween and having an entrance and an exit to create a one way flow of the one or more spinning tops through the second side track and onto the middle of the battling surface.

In yet another embodiment, one or more semi-circular redirection zones are provided adjacent the battling surface and include a side rail partially extending the perimeter of the redirection zone. In another embodiment, the one or more redirection zones further include an exit area opposite the side rail at the border between the battling surface and the redirection zone creating a one-way flow pattern of spinning toy tops from each redirection zone to the middle area of the battling surface, and in another embodiment, a step at is further provided at the exit area of the one or more redirection zones along the border between the redirection zone and the battling surface, preventing spinning toy tops at the periphery of the battling surface from entering the exit area of the one or more redirection zones.

In another embodiment, the barrier at the exit of the side track further includes a diverter element coupled to the arena at the exit of the side track and disposed at the border between the side track and the battling surface narrowing the side path at the battling surface for directing spinning toy tops to the middle of the battling surface and creating a barrier at the narrowed side path for preventing spinning toy tops from entering the exit of the side path. In another embodiment, a second diverter element is coupled to the arena at the entrance of the side track and disposed at the border between the side track and the battling surface for preventing spinning toy tops from entering the side path at the entrance containing the spinning toy tops within the battling surface for combat.

In another embodiment of the invention, a battle arena apparatus in combination with a toy top includes a concave arena having a battling surface for one or more toy tops to engage each other in combat, the battling surface includes a middle area surrounded by a periphery area, one or more side tracks extend from the battling surface for redirecting the one or more tops from the periphery of the battling surface to the middle area for combat, each of the one or more side tracks includes a side rail partially extending the length of the side track and defining a side path for redirecting the one or more tops from the periphery to the middle of the battling surface. An entrance to each of the one or more side tracks along the periphery of the battling surface is included, along with and an exit at each of the one or more side tracks at an end of each track opposite the entrance, and a banked surface is included at each side path inclining toward the side rail of the one or more side tracks for launching the one or more toy tops onto the middle of the battling surface from the exit of each side path of the one or more side tracks. A barrier is included at the exit of the one or more side tracks for preventing the one or more toy tops at the periphery of the arena from entering the one or more side tracks at the exit, and one or more toy tops are included having an elongated and generally cylindrical tip with a partially flat riding tip surface for gliding along the one or more banked side paths, and an outer surface for engaging the one or more side rails for directing the one or more toy tops through the side tracks and out each exit creating a one-way flow pattern through the one or more side tracks and onto the middle of battling surface to continuously engage each other in combat.

In another embodiment, the barrier at the exit of the one or more side tracks further includes a barrier step elevated from the surface of the periphery of the battling surface for preventing spinning tops at the battling surface from entering the exit of the one or more side tracks. In another embodiment, each of the one or more side tracks further includes a second side rail partially extending along the length of each side track and coordinating with the first side rails defining the side paths therebetween first and second side rails.

In another embodiment, one or more semi-circular redirection zones are included adjacent the battling surface and including a side rail partially extending the perimeter of the redirection zone and an exit area opposite the side rail creating a one-way flow pattern to continuously redirect spinning toy tops to the middle of the battling surface for engagement with other spinning tops in combat. In another embodiment, a barrier step is included at the exit of the one or more semi-circular redirection zones, the barrier step is disposed along the border between the one or more redirection zones and the battling surface for preventing spinning tops at the periphery of the battling surface from entering the exit area of the one or more redirection zones, and in another embodiment, a single elongated barrier step is included along the exit of the one or more side tracks and the exit area of the one or more redirection zones.

In yet another embodiment, a barrier step is further included around the entire perimeter of the battling surface except at the entrance of the one or more side tracks. In another embodiment, the barrier at the exit of the one of one or more side tracks further includes a diverter element coupled to the arena at the exit of the one or more side tracks and disposed at the border between the side track and the battling surface narrowing the side path at the battling surface for directing spinning toy tops to the middle of the battling surface and creating a barrier at the narrowed side path for preventing spinning toy tops from entering the exit of the one or more side paths.

In another embodiment of the invention, a battle arena game apparatus in combination with a toy top includes a concave arena having a battling surface for one or more spinning toy tops to engage each of the in combat, the battling surface having a middle area surrounded by a peripheral area, a side track extends from the perimeter area of the battling surface, a side rail partially extends the length of the side track and defining a side path along the side track, with a banked or inclined surface along the side path, the banked surface inclining toward the side rail. A diverter element is coupled to the arena at the side track and disposed at the border between the side track and the battling surface narrowing the side path at the battling surface for directing spinning toy tops to the middle of the battling surface and creating a barrier at the narrowed side path for preventing spinning toy tops from entering the side path at the diverter element, and one or more spinning toy tops having an elongated tip with a partially flat riding tip surface for gliding along the banked side path and having an outer tip surface for engaging the side rail to direct a one-way flow pattern of the one or more spinning toy tops from the perimeter area of the battling surface, through the side track, and launching back into the middle of the battling surface to continuously engage each other in combat.

In another embodiment, a second side rail partially extends along the length of the side track and coordinates with the first side rail defining the side path therebetween first and second side rails. In yet another embodiment, a second diverter element is coupled to the arena at the entrance of the side track and disposed at the border between the side track and the battling surface for preventing spinning toy tops from entering the side path at the entrance for containing the spinning toy tops within the battling surface for combat.

Briefly, the present inventions provides a unique battle arena game apparatus and toy top combination including one or more symmetrical side tracks for redirecting spinning tops at a periphery of the battle arena, back into a middle of a battling surface by providing an entrance to each side track at the periphery of the battle arena and an exit at each side track at an end opposite the entrance. Further included is a barrier at each exit preventing spinning tops from entering the exit of each side track creating a one-way flow of spinning tops from the periphery of the battle arena through side tracks and exiting onto a middle of a battling surface to maximize the frequency of collisions between actively spinning tops for enhanced game play and fun for a user.

BRIEF DESCRIPTION OF THE DRAWINGS

For the purpose of facilitating an understanding of the inventions, the accompanying drawings and description illustrate a preferred embodiment thereof, from which inventions, structure, construction and operation, and many related advantages may be readily understood and appreciated.

FIG. 1A is a perspective view of a toy battling arena of the present invention illustrating a concave arena having battling surface and symmetrical side tracks extending therefrom with arrows illustrating a one-way flow for spinning tops to exit onto a middle area of the battling surface, while

DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
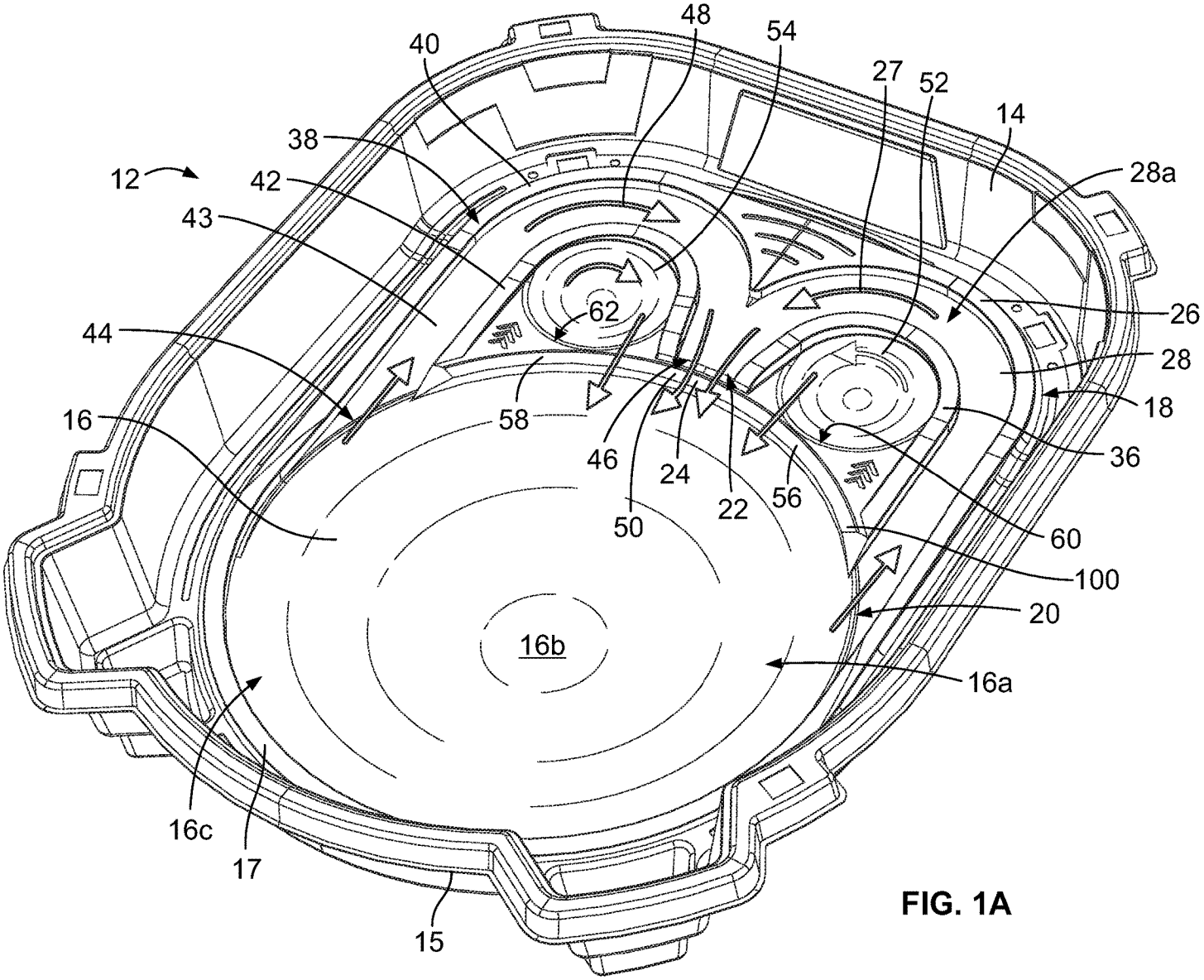
Figure 1B:
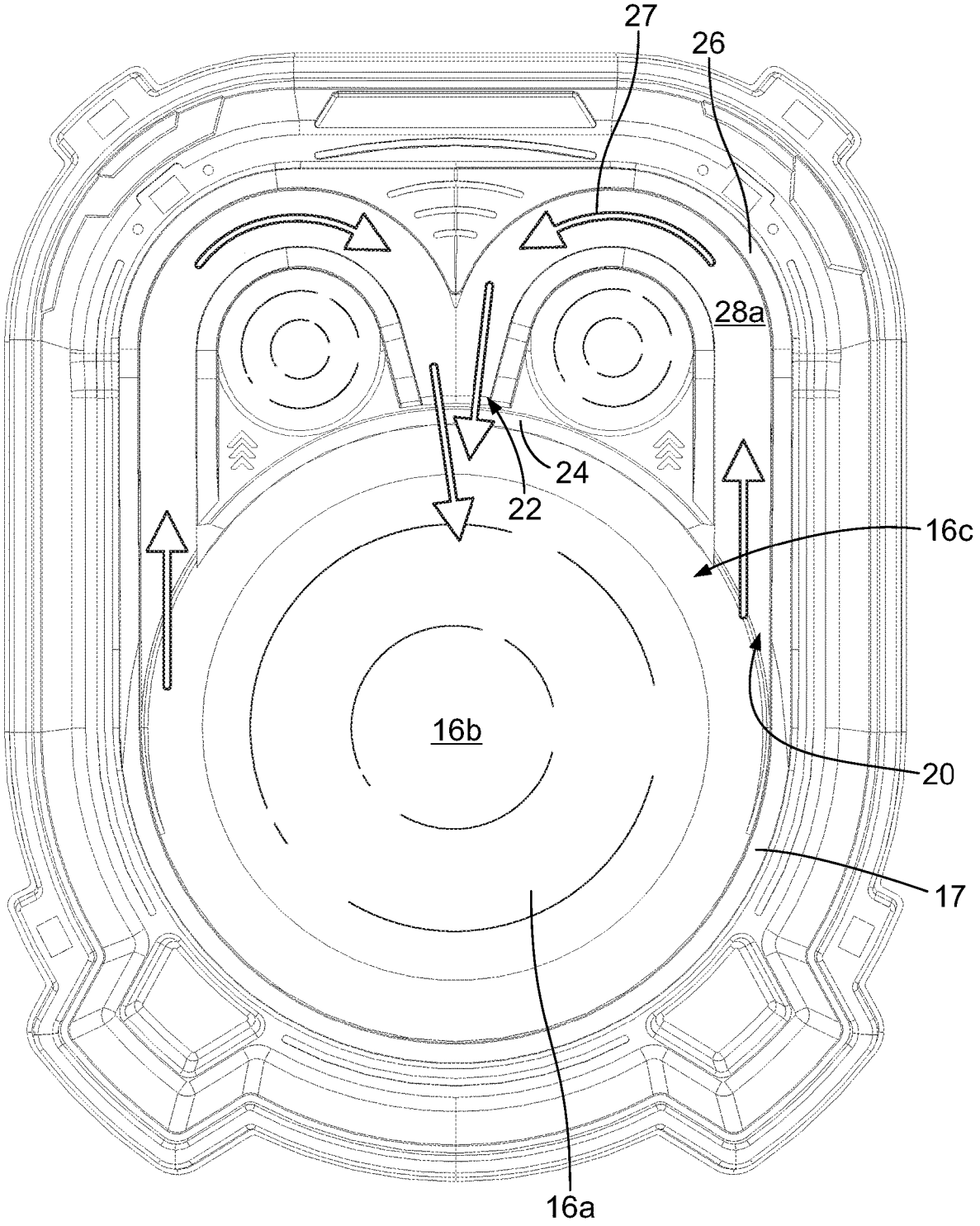
FIG. 1B is a plan view of the toy battle arena game apparatus illustrating the one-way flow of spinning toy tops along the apparatus.

A toy battle arena apparatus 12, as seen in FIGS. 1A-1B, includes one or more symmetrical side tracks creating a one-way flow pattern across the apparatus to maximize the frequency of collisions between actively spinning tops for enhanced game play and fun for a user. The battle arena apparatus 12, provides a contained space in which toy tops can be launched and is generally a one-piece molded plastic stadium-like apparatus with an exterior wall 14 to contain the spinning tops within and may include a lid with user friendly openings for launching toy tops.

The battle arena apparatus 12, includes a main concave battle arena 16 having a battling surface 16*a* for one or more toy tops to engage each other in combat. In the present described embodiment, the battle arena 16 is generally circular in shape and supported by a base 15 adjoining the exterior wall 14. The battling surface 16*a* includes a middle area 16*b* surrounded by an outer periphery or perimeter area 16*c*. The battle arena 16 includes a rim, lip or step 17 partially circling the arena at the uppermost point of the periphery of the arena to provide a barrier to maintain spinning tops within the arena.

A user can launch toy tops directly into the battle arena 16, with tops spinning in either a clockwise or counter clockwise direction. Spinning tops will circle around the battle arena 16 at the battling surface 16*a* and collide with other spinning tops residing at the middle area 16*b* of the battling surface to engage each other in combat.

A side track 18 extends from the concave arena at the periphery area of the battling surface, as seen in FIG. 1A, and includes a designated entrance 20 and exit 22. The side track 18 includes a curved portion 27 for bending the side track in such a way as to connect the periphery of the battling surface to the middle area of the battling surface. The side track is connected to the concave arena, and in the present described embodiment, the side track is integral with the periphery or perimeter area 16*c* of the battling surface 16*a*. The entrance of the side track mechanically engages the outer periphery 16*c* of the battling surface and the exit of the side track engages the middle 16*b* of the battling surface as spinning tops are redirected into the middle area after passing through the side track 18. The side track 18 redirects spinning toy tops at the periphery of the battling surface to the middle area of the battling surface as they pass though the side track 18.

The exit 22 of the side track 18 is at an end of the track opposite the entrance 20, as seen in FIG. 1B. A barrier 24 is disposed at the exit 22 of each side track and stretches at least partially across each entire exit to the extent suitable for preventing one or more spinning tops from entering the exit of the side track. In the present described embodiment, the barrier includes a step 24 that is integral with the periphery or perimeter area 16*c* of the battling surface 16*a* and is elevated beyond an uppermost point of the periphery of the battling surface 16*a*. The elevation of the step 24 with respect to the battling surface 16*a*, also provides a launching action to the spinning tops which are exiting the side track over the step and propelling to the middle area 16*b* of the battling surface.

A side rail 26 partially extends the length of each side track 18, is seen in FIG. 1A, and defines a side path 28 along the side track. The side rail 26 is elevated beyond the uppermost point of the surface of the side path 28, and in the present described embodiment, the side rail 26 is integral with the side path 28 and the rim/lip or step 17, forming a continuous barrier to direct spinning tops at the periphery of the concave arena 16 or battling surface 16*a* seamlessly into the side path for redirection of the spinning tops to the middle of the battling surface 16*b*.

The side path 28, includes a banked or inclined surface 28*a*, as seen in FIG. 1A, with the banked surface inclining toward the side rail. In the present described embodiment, the banked surface 28*a* generally extends from the entrance of the side track to the exit of the side track. The angle and pitch of the banked surface efficiently directs spinning tops along the side path and around the curved portion 27 in order to launch the spinning tops from the exit of the side path to the middle of the battling surface.

Figure 2:
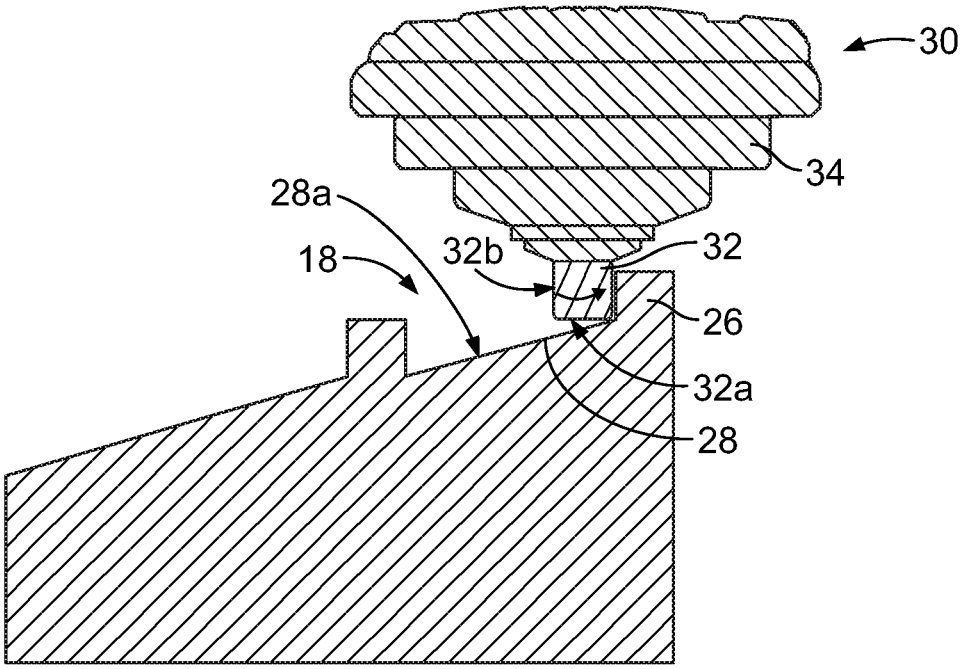
FIG. 2 is a cross sectional view of a spinning toy top riding along a side rail of a side track, illustrating a circular tip with a generally flat riding surface of the toy top, where the circular tip is suitable in length and size to ride along the side rail.
Figure 3:
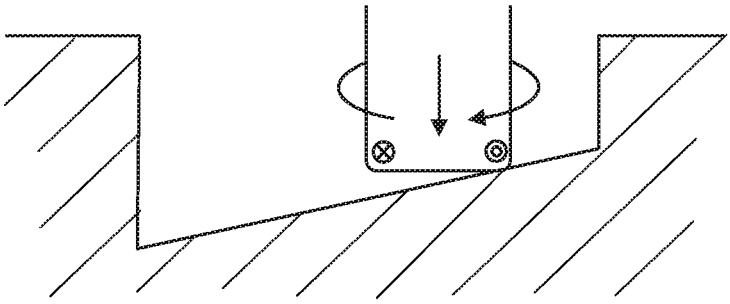
FIG. 3 Prior Art
FIG. 3 is a cross sectional view of a tip of a prior art toy top which is circular in shape and shown captured within a running groove and rotating while in point contact with a bottom surface of the running groove.

One or more spinning toy tops 30 are in combination with the battle arena game apparatus 12, as shown in FIG. 2. The one or more spinning tops 30 can be launched into the battle arena rotationally spinning in either a clockwise or counter clockwise direction and travel toward the right or left, accordingly, as dictated by a rotational spin of each top.

The one or more spinning toy tops 30 each has an elongated tip 32 with a partially flat riding tip surface 32*a* for gliding along the banked side path 28. The one or more tops further include an outer tip surface 32*b* for engaging the side rail 26. The tip of each spinning top tilts to a point, as seen in FIG. 2, when the widest part of the tip hits the side rail. Additionally, the spinning tops accelerate slightly when the tip 32 hits the side rail 26 and is then directed in a one-way flow of the one or more spinning tops from the perimeter area of the battling surface, through the side track to be launched into the middle area of the battling surface for continuous engagement with each other in combat.

The elongated tip 32 is of a length suitable to smoothly ride along the side rail 26 while keeping an upper portion 34 of the top 30 from contacting the side rail and interfering with the smooth travel of the one or more spinning tops 30 through the side track. The tip length allows the one or more tops 30 to ride up on the banked surface or slope 28*a* of the curved portion 27 of the side track and run along the side rail at a fast rate of speed so that the one or more spinning tops can exit the side track at a quick velocity without being slowed down by the side track.

In the present described embodiment, a second rail 36 extends partially or completely along a length of the side track, on a side of the track opposite the first side rail 26, as seen in FIG. 1A, and coordinates with the first side rail 26 to define the side path 28 therebetween the first and second side rails. Similar to the first side rail 26, the second side rail 36 is elevated beyond the uppermost point of the surface of the side path 28, and the side rail 36 is integral with the side path 28 forming a continuous barrier on the side of the side path 28 opposite the first side rail to direct spinning tops at the periphery of the concave arena 16 or battling surface 16*a* seamlessly into the side path for redirection of the tops to the middle of the battling surface 16*b*.

In the present described embodiment, a second side track 38 extends from the periphery area of the battling surface and is symmetrical with the first side track 18, is seen in FIG. 1A. The second side track 38 also creates a one-way flow of the one or more spinning tops through the second side track to the middle area of the battling surface. Like the first side track 18, the second side track 38 includes a first and second side rail, 40 and 42, respectively, defining a second banked side path 43 therebetween. The banked or inclined surface along the path inclines toward the first side rail 40 and generally extends from a designated entrance 44 into the second side track, to a designated exit 46 from the side track. The angle and pitch of the banked surface efficiently directs spinning tops along the second side path and around a curved portion 48 in order to launch the spinning tops from the exit of the second side path to the middle of the battling surface.

The second side track 38 extends from the perimeter area of the battling surface, as seen in FIG. 1A, mechanically engaging the concave arena, and as seen in the present described embodiment, the second side track is integral with the periphery or perimeter area 16*c* of the battling surface 16*a*. The entrance of the second side track mechanically engages the outer periphery 16*c* of the battling surface and the exit of the second side track engages the middle 16*b* of the battling surface as spinning tops are redirected into the middle area after passing through the second side track 38. The second side track 38 redirects spinning toy tops at the periphery of the battling surface to the middle area of the battling surface as they pass through the second side track 38.

The exit 46 of the second side track 38 is at an end of the second side track opposite the entrance 44. A barrier 50 is disposed at the exit 46 second side track 38 and stretches at least partially across the entire exit to the extent suitable for preventing one or more spinning tops from entering the exit of the second side track. In the present described embodiment, the barrier includes a step 50 that is integral with the periphery or perimeter area 16*c* of the battling surface 16*a* and is elevated beyond an uppermost point of the periphery of the battling surface 16*a*. The elevation of the step 50 with respect to the battling surface 16*a*, also provides a launching action to the spinning tops which are exiting the second side track over the step 50 and propelling to the middle area 16*b* of the battling surface.

In the present described embodiment, one or more symmetrical side tracks extend from the concave area for redirecting one or more spinning tops from the periphery of the arena to the middle of the battling surface to maximize the frequency of collisions and interactions between actively spinning tops. The one or more symmetrical side tracks are disposed side by side, as seen in FIG. 1A, allowing spinning tops to enter a side track from either/both directions. Tops spinning in a clockwise direction and traveling to the right along the periphery can enter the second side track to be redirected, and similarly, tops spinning in a counterclockwise direction and traveling to the left along the periphery can enter the first side track to be redirected to the middle of the battling surface.

Figure 4:
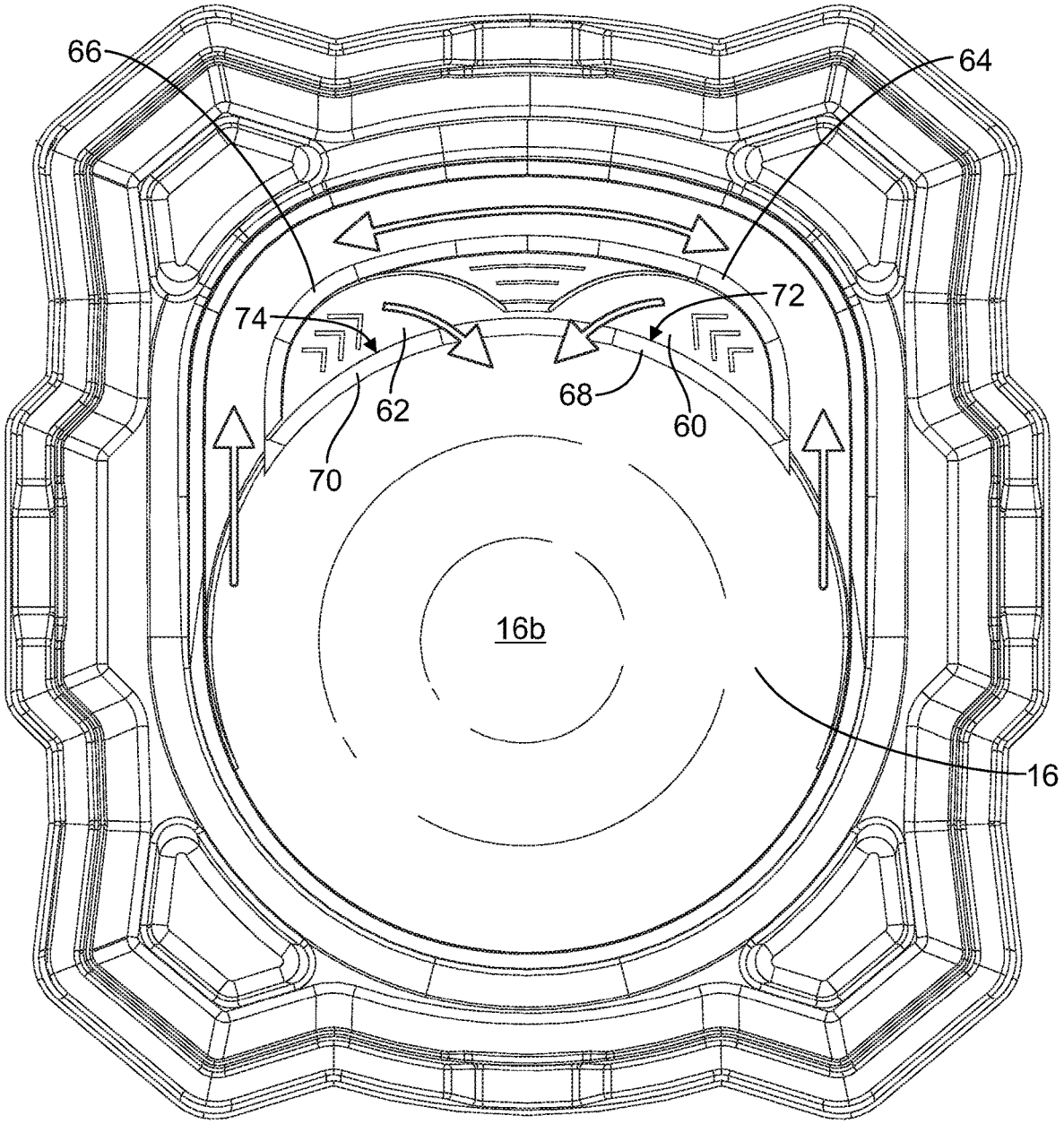
FIG. 4 is a plan view of a toy battle arena of the present invention, illustrating an elongated side track configuration and symmetrical redirection areas adjacent the battle arena.

The battle arena game apparatus 12, further includes one or more mini circular or semi-circular redirection areas adjacent the concave arena/battling surface, as seen in FIGS. 1A and 4. The one or more semi-circular redirection zones includes a side rail at least partially extending the perimeter of the redirection zone and an exit area from the redirections zone disposed opposite the side rail and disposed at the border between the battling surface and redirection zone creating a one-way flow pattern of spinning toy tops from each redirection zone to the middle area of the battling surface. A barrier and/or step is disposed at each exit area of the one or more redirection zones along the boarder between the redirection zone and the battling surface to prevent spinning toy tops at the periphery of the battling surface from entering the exit area of the one or more redirection zones.

In the present described embodiment, a first mini circular redirection area 52, and a second mini circular redirection area 54, each are mini concave circles including a side rail partially extending the perimeter of each redirection area. Side rail 36 extends partially around redirection area 52 partially defining redirection area 52, in addition to defining the first side track 18 as described above. Also, side rail 42 extends partially around redirection area 54 partially defining redirection area 54, in addition to defining the second track 38. An exit area, 60 and 62, respectively, is disposed at each mini circular redirection area opposite the side rails 36 and 42, respectively, and a barrier/step 56 and 58, respectively, is disposed along the border between each redirection and the concave arena, at each exit area 60 and 62, respectively, for preventing spinning tops at the periphery of the concave arena from entering the redirection areas at the barrier and/or step.

In the present described embodiment, a single elongated barrier step 100, is disposed along the exit of the one or more side tracks and the exit area of the one or more redirection zones, as seen in FIG. 1A. The barrier step 100 is disposed along the entire top perimeter portion/periphery of the concave arena which lies between entrance 20 of the first side track, and entrance 44 of the second side track, as seen in FIG. 1A. The single elongated barrier step 100 creates a simple single molded step disposed along both exits 22 and 46 of the first and second side tracks, 18 and 38, respectively, and both exit areas 60 and 62 of the first and second redirection areas, 52 and 54, respectively. The single elongated barrier step 100 in combination with the rim, lip or step 17 partially circling the battle arena 16 at the uppermost point of the periphery of the arena creates a barrier step around the entire perimeter of the battling surface except at the entrance of the one or more side tracks.

Side rails 36 and 42 prevent spinning tops from entering side tracks 18 and 38, respectfully, as spinning tops circle within the mini circular redirection areas, 52 and 54, respectfully, and are continuously redirected to the middle of the battling surface to engage other spinning tops in combat. The flat tip of the one or more toy tops travels on a periphery of the mini circular redirection areas, knocking into the side rails where the spinning top are then pushed to the exit of each redirection area. A user can launch toy tops into the mini circular areas 52 and 54 for further launching of the spinning tops out of the exits of the redirection areas and into the middle of the battling surface for combat.

Semi-circular redirection areas, 60 and 62, as seen in FIG. 4, are similar to mini circular redirection areas 52 and 54, as described above. Semi-circular redirection areas 60 and 62, are each semi-circular in shape, sit side by side, and are adjacent the concave arena/battling surface. First and second semi-circular redirection areas, 60 and 62, respectfully, each include a side rail, 64 and 66, respectfully, partially extending the perimeter of the redirection area. A barrier/step, 68 and 70, respectively, at each redirection area, 60 and 62, is further included along the border between the redirection areas and the concave arena/battling surface for preventing spinning tops at the periphery of the concave arena/battling surface from entering the redirection areas at the barrier/step.

An exit area of each semi-circular redirection area is disposed opposite each side rail, as seen in FIG. 4. Exit area 72 is disposed opposite side rail 64 and exit area 74 is disposed opposite side rail 66. Side rails 64 and 66 extending partially around each redirection area, 60 and 62, respectively, and direct spinning tops within each redirection area to exit only at the exit areas and into the middle of the concave arena/battling surface. In the present described embodiment, as seen in FIG. 4, step 68 at exit area 72 and step 70 at exit area 74, combine to create a one-way flow of spinning tops launching out of the semi-circular redirection areas into the middle of the battling surface. Side rails 64 and 66 also prevent spinning tops from entering side tracks as spinning tops circle within the semi-circular redirection areas 60 and 62 and are continuously redirected to the middle of the battling surface 16*b* to engage other spinning tops in combat. A user can launch toy tops into the semi-circular areas for further launching of the spinning tops out of the exits of the redirection areas and into the middle of the battling surface for combat.

Figure 5:
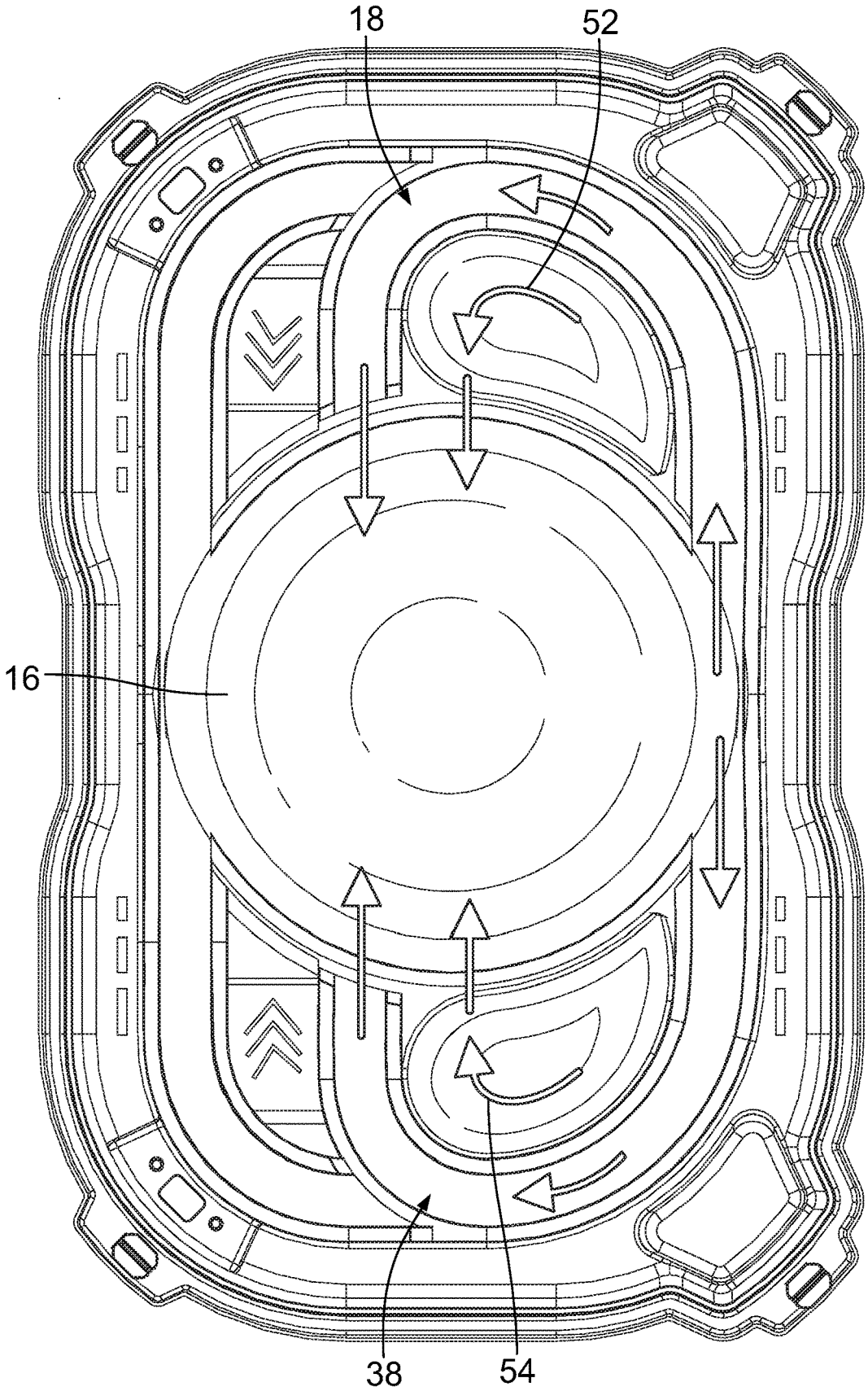
FIG. 5 is a plan view of a toy battle arena of the present invention, illustrating symmetrical side tracks at opposite sides of the concave battling surface with each side track having a designated entrance and exit exclusive to each of the side tracks.

Additionally, as seen in FIG. 5, there are also one or more symmetrically configured side tracks extending from the battle arena 16 on opposite sides of the arena, as seen in FIG. 5, rather than side by side on the same side of the arena, as seen in FIG. 1A. As seen in FIG. 5, the first side track 18 is disposed on a first side of the concave arena/battling surface 16 and the second side track 38 is disposed on a second side of the arena, opposite the first side. As is detailed above and shown in FIG. 1A, the symmetry of the side tracks allows spinning tops to enter a side track from either/both directions, such that tops spinning in a clockwise direction and traveling to the right along the periphery can enter the second side track to be redirected, and tops spinning in a counterclockwise direction and traveling to the left along the periphery can enter the first side track to be redirected to the middle of the battling surface.

Also seen in FIG. 5, are two mini semi-circular redirections areas 52 and 54, which are slightly less circular and concave as the mini-circular areas 52 and 54 shown in FIG. 1A. Redirection areas 52 and 54, as seen in FIG. 5, are designed and operate in the same way as in FIG. 1A, but are spaced apart and located on opposite sides of the concave arena/battling surface. Spinning tops launched in redirection areas 52 and 54, as seen in FIG. 5, are prevented from entering side tracks 18 and 38 respectfully, and instead are launched back into the middle of the concave arena/battling surface to engage other spinning tops in combat.

In an alternative presently described embodiment, the barrier at an exit of one or more side tracks includes a diverter element 80 coupled to the arena at the exit of the side track and disposed at the border between the side track and the battling surface. The diverter element narrows the side path at the battling surface for directing spinning toy tops to the middle of the battling surface and creating an exit and a barrier at the narrowed side path for preventing spinning toy tops from entering the now created exit of the side path. In the present described invention, as seen in FIGS. 6 and 7, the diverter element 80 is a one-piece molded plastic element made of a resilient plastic material that is suitable for the diverter element to be snapped into, and easily removed from the battle arena game apparatus without breaking or degrading.

Figure 7:
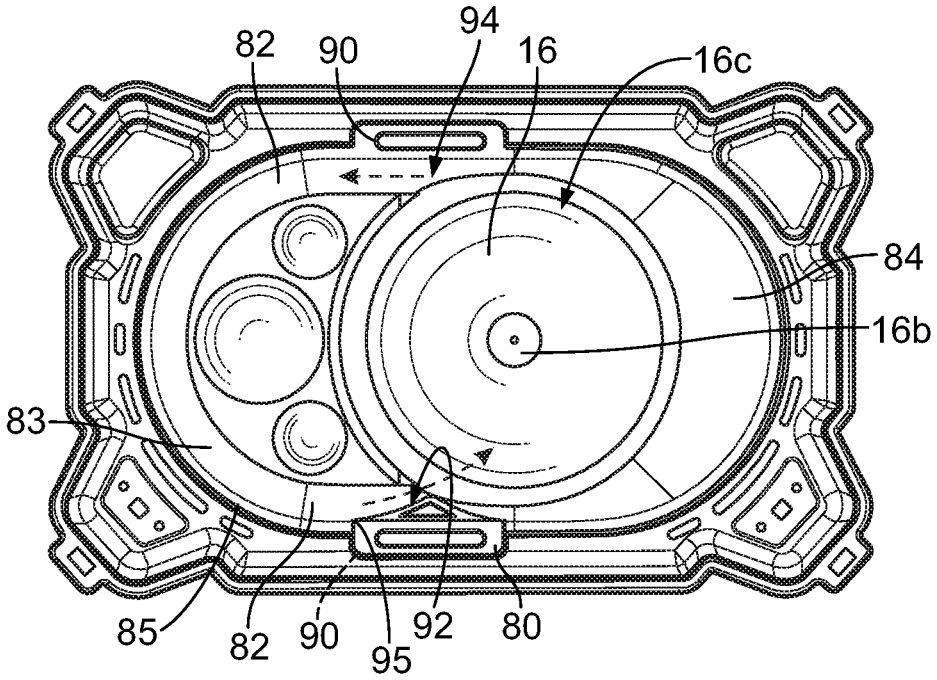
FIG. 7 is a plan view of battle arena apparatus having a diverter element coupled at the arena adjacent the side track and battling surface for creating a one-way flow of spinning to tops through the side track to the middle area of the battling surface to maximize collisions and interactions between actively spinning tops.

The diverter element is a removable barrier which can be inserted into a battle arena game apparatus, as seen in FIG. 7, for narrowing side path 83 in order to direct the one or more spinning tops to the middle area 16*b* of the battling surface. The diverter element 80 can also be easily removed from the apparatus to then allow spinning tops to circle the periphery 16*c* of the battling surface when desired by the user. An elevated extension portion 84 of the battling surface, inclined away from the battling surface, can capture spinning tops which over shoot the periphery 16*b* of the battling surface as well as act as an extension to side path 83 for allowing spinning tops to circle around the periphery of the concave arena/battling surface when the diverter element is removed from the battle arena apparatus.

Figure 6:
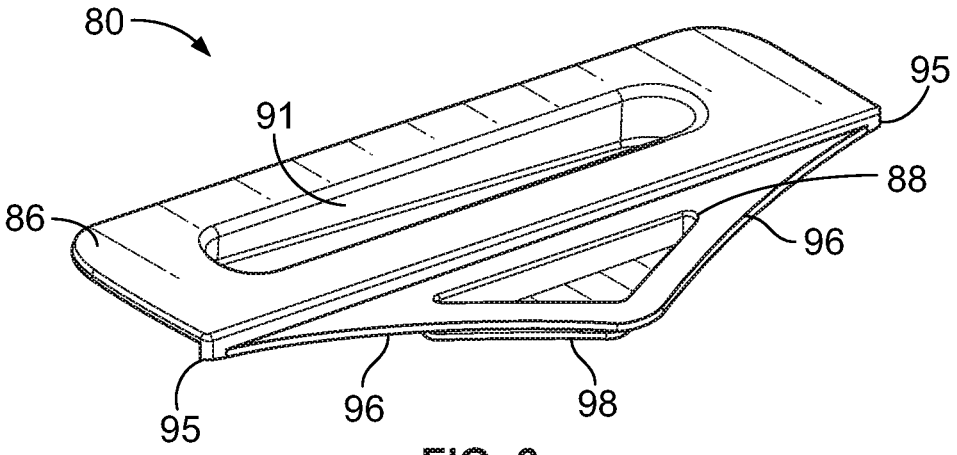
FIG. 6 is a perspective view of a diverter element.

As seen in FIG. 6, the diverter element includes a rectangular snap in portion 86 and a triangular barrier portion 88. The rectangular snap in portion 86 includes a depression 91 which is keyed to fit snugly into a diverter recessed cavity 90 carved into the battle arena game apparatus and disposed adjacent the side track 82 at a point where the side track meets the periphery of the battling surface, as seen in FIG. 7. The triangular barrier portion 88 includes an elongated edge 96 along two sides of the triangular portion with the third side of the triangular portion (extending between edge points 95) attached to the rectangular portion 86. The two elongated edges 96 are generally symmetrical as they extend from the third side which is integral with the rectangular portion, as seen in FIG. 6.

In use, the diverter element 80 is inserted into the recessed cavity 90 with the diverter depression 91 of the rectangular portion snapping into the cavity 90, and the two elongated edges 96 hanging over the side path 83 and/or elevated extension portion 84. The two elongated edges each terminate at an end point edge 95, as seen in FIG. 6. Each end point edge 95 seamlessly merges with rail 85 of the side track 82 to provide a smooth transition between rail 85 and edge 96 of the diverter element. Additionally, a support portion 98 of the diverter element is disposed along a side of the triangular portion which rests on the battle arena apparatus when inserted into the apparatus, elevating the elongated edges 96 about 4 mm from the surface of the side path 83 and extension portion 84, supporting the edges in a stable barrier position as well as facilitating the direction of the spinning tops to the middle of the battling surface.

The elongated tips 32 of the one or more spinning toy tops rides smoothly along the rail 85 transitioning seamlessly along end point edge 95 and onto one of the elevated elongated edges 96 before launching into the middle area of the battling surface. The slightly elevated height of the elongated edge 96 and the seamless connection between the end point edge 95 and the rail 85, perpetuate and preserve the quick velocity of the spinning toy tops for proper riding along elongated edge 96 and launching of the tops into the middle area of battling surface from the side track 82.

The battle arena game apparatus, as seen in FIG. 7, includes only one side track 82 without a designated entrance or exit into the side track. Insertion of the diverter element into the recessed cavity 90 creates a defined exit from side track 82 at the diverter element, which narrows side path 83 diverting spinning tops to the middle of the battling surface. Insertion of the diverter element also creates a designated exit 92 at the diverter barrier at the side track, preventing spinning tops from entering the side path at the diverter element. The one or more spinning toy tops in the concave arena/battling surface can also only enter the side track at the now created entrance 94, disposed opposite the exit 92, when the diverter element is inserted. The symmetrical nature of the two elongated edges 96 allows for the same diverter element to be utilized as a barrier on either side of the side track 82 and snapped into either and/or both cavities 90 of the battle arena game apparatus, as seen in FIG. 7. The diverter element coupled to the battle arena game apparatus, as seen in FIG. 7, creates a one-way flow pattern of spinning toy tops through the side track 82 to the middle area 16*b* of the battling surface to maximize collisions and interactions between actively spinning tops, and fun for the user.

In another presently described alternative embodiment, a second diverter element 80 is coupled to the arena at the entrance 94 of the side track 82 and disposed at the border between the side track and the battling surface. The second diverter element 80 prevents spinning toy tops from entering the side path at the entrance and thus containing the spinning toy tops within the battling surface for combat. First and second diverter elements inserted into the battle arena game apparatus, as seen in FIG. 7, will contain spinning toy tops to the concave area/battling surface and elevated extension portion 84 for combat.

What is claimed is:

1. A battle arena game apparatus in combination with a toy top, comprising:

a concave arena having a battling surface for one or more spinning tops to engage each other in combat, the battling surface having a middle area surrounded by a periphery area;

a side track extending from the periphery area of the battling surface, the side track having an entrance and an exit;

a side rail partially extending the length of the side track and defining a side path along the side track;

a banked surface along the side path, the banked surface inclining toward the side rail;

a barrier at the exit of the side track for preventing the one or more spinning tops from entering the exit of the side track; and one or more spinning toy tops having an elongated tip with a partially flat riding tip surface for gliding along the banked side path and having an outer tip surface for engaging the side rail to direct a one-way flow of the one or more spinning tops from the periphery area of the battling surface, through the side track, and launching to the middle area of the battling surface to continuously engage spinning toy tops in combat.

2. The battle arena game apparatus according to claim 1, wherein the barrier at the exit of the side track further comprising a step elevated from the surface of the periphery of the battling surface for preventing spinning tops at the battling surface from entering the exit of the side track.

3. The battle arena game apparatus according to claim 2, further comprising a second side rail partially extending along the length of the side track and coordinating with the first side rail defining the side path therebetween first and second side rails.

4. The battle arena game apparatus according to claim 3, further comprising a second side track symmetrical with the first side track and including first and second side rails and a banked surface inclining toward the first side rail defining a second banked side path therebetween and having an entrance and an exit to create a one-way flow pattern of the one or more spinning tops through the second side track onto the middle area of battling surface.

5. The battle arena game apparatus according to claim 4, further comprising one or more semi-circular redirection zones adjacent the battling surface and including a side rail partially extending the perimeter of the redirection zone.

6. The battle arena game apparatus according to claim 5, wherein the one or more redirection zones further comprising an exit area opposite the side rail at the border between the battling surface and the redirection zone creating a one-way flow pattern of spinning toy tops from each redirection zone to the middle area of the battling surface.

7. The battle arena game apparatus according to claim 6, further comprising a step at the exit area of the one or more redirection zones along the border between the redirection zone and the battling surface, preventing spinning toy tops at the periphery of the battling surface from entering the exit area of the one or more redirection zones.

8. The battle arena game apparatus according to claim 1, wherein the barrier at the exit of the side track further comprises a diverter element coupled to the arena at the exit of the side track and disposed at the border between the side track and the battling surface narrowing the side path at the battling surface for directing spinning toy tops to the middle of the battling surface and creating a barrier at the narrowed side path for preventing spinning toy tops from entering the exit of the side path.

9. The battle arena game apparatus according to claim 8, further comprising a second diverter element coupled to the arena at the entrance of the side track and disposed at the border between the side track and the battling surface for preventing spinning toy tops from entering the side path at the entrance containing the spinning toy tops within the battling surface for combat.

10. A battle arena apparatus in combination with a toy top, comprising:

a concave arena having a battling surface for one or more toy tops to engage each other in combat, the battling surface having a middle area surrounded by a periphery area;

one or more side tracks extending from the battling surface for redirecting the one or more tops from the periphery of the battling surface to the middle area for combat, each of the one or more side tracks including a side rail partially extending the length of the side track and defining a side path for redirecting the one or more tops from the periphery to the middle of the battling surface;

an entrance to each of the one or more side tracks along the periphery of the battling surface and an exit at each of the one or more side tracks at an end of each track opposite the entrance;

a banked surface at each side path inclining toward the side rail of the one or more side tracks for launching the one or more toy tops onto the middle of the battling surface from the exit of each side path of the one or more side tracks;

a barrier at the exit of the one or more side tracks for preventing the one or more toy tops at the periphery of the arena from entering the one or more side tracks at the exit; and one or more toy tops having an elongated and generally cylindrical tip with a partially flat riding tip surface for gliding along the one or more banked side paths, and an outer surface for engaging the one or more side rails for directing the one or more toy tops through the side tracks and out each exit creating a one-way flow pattern through the one or more side tracks and onto the middle of battling surface to continuously engage each other in combat.

11. The battle arena according to claim 10, wherein the barrier at the exit of the one or more side tracks further comprises a barrier step elevated from the surface of the periphery of the battling surface for preventing spinning tops at the battling surface from entering the exit of the one or more side tracks.

12. The battle arena according to claim 11, wherein each of the one or more side tracks further comprises a second side rail partially extending along the length of each side track and coordinating with the first side rails defining the side paths therebetween first and second side rails.

13. The battle arena according to claim 12, further includes one or more semi-circular redirection zones adjacent the battling surface and including a side rail partially extending the perimeter of the redirection zone and an exit area opposite the side rail creating a one-way flow pattern to continuously redirect spinning toy tops to the middle of the battling surface for engagement with other spinning tops in combat.

14. The battle arena apparatus according to claim 13, further comprising a barrier step at the exit of the one or more semi-circular redirection zones, the barrier step is disposed along the border between the one or more redirection zones and the battling surface for preventing spinning tops at the periphery of the battling surface from entering the exit area of the one or more redirection zones.

15. The battle arena apparatus according to claim 14, further comprising a single elongated barrier step along the exit of the one or more side tracks and the exit area of the one or more redirection zones.

16. The battle arena apparatus according to claim 12, further comprising a barrier step around the entire perimeter of the battling surface except at the entrance of the one or more side tracks.

17. The battle arena apparatus according to claim 10, wherein the barrier at the exit of the one of one or more side tracks further comprises a diverter element coupled to the arena at the exit of the one or more side tracks and disposed at the border between the side track and the battling surface narrowing the side path at the battling surface for directing spinning toy tops to the middle of the battling surface and creating a barrier at the narrowed side path for preventing spinning toy tops from entering the exit of the one or more side paths.

18. A battle arena game apparatus in combination with a toy top, comprising:

a concave arena having a battling surface for one or more spinning toy tops to engage each of the in combat, the battling surface having a middle area surrounded by a peripheral area;

a side track extending from the perimeter area of the battling surface;

a side rail partially extending the length of the side track and defining a side path along the side track;

a banked or inclined surface along the side path, the banked surface inclining toward the side rail;

a diverter element coupled to the arena at the side track and disposed at the border between the side track and the battling surface narrowing the side path at the battling surface for directing spinning toy tops to the middle of the battling surface and creating a barrier at the narrowed side path for preventing spinning toy tops from entering the side path at the diverter element; and one or more spinning toy tops having an elongated tip with a partially flat riding tip surface for gliding along the banked side path and having an outer tip surface for engaging the side rail to direct a one-way flow pattern of the one or more spinning toy tops from the perimeter area of the battling surface, through the side track, and launching back into the middle of the battling surface to continuously engage each other in combat.

19. The battle arena game apparatus according to claim 18, further comprising a second side rail partially extending along the length of the side track and coordinating with the first side rail defining the side path therebetween first and second side rails.

20. The battle arena game apparatus according to claim 18, further comprising a second diverter element coupled to the arena at the entrance of the side track and disposed at the border between the side track and the battling surface for preventing spinning toy tops from entering the side path at the entrance for containing the spinning toy tops within the battling surface for combat.

* * * * *